US006792627B2

(12) United States Patent
Sangha et al.

(10) Patent No.: US 6,792,627 B2
(45) Date of Patent: Sep. 21, 2004

(54) AERATED BATH

(75) Inventors: Mohan Singh Sangha, Bradford (GB); Darren Kirk Allison, Pudsey (GB)

(73) Assignee: Clearwater Collection Limited, Bradford (GB)

( * ) Notice: Subject to any disclaimer, the term of this patent is extended or adjusted under 35 U.S.C. 154(b) by 0 days.

(21) Appl. No.: 10/080,241

(22) Filed: Feb. 21, 2002

(65) Prior Publication Data

US 2003/0154545 A1 Aug. 21, 2003

(51) Int. Cl.[7] ..... A61H 33/06

(52) U.S. Cl. ..... 4/541.5; 4/541.4
(58) Field of Search ..... 4/541.5, 541.6

(56) References Cited

U.S. PATENT DOCUMENTS

| | | | | | |
|---|---|---|---|---|---|
| 3,467,969 | A | * | 9/1969 | Szekely | 4/541.5 |
| 4,984,583 | A | * | 1/1991 | Peterson et al. | 4/541.5 X |
| 5,172,433 | A | * | 12/1992 | Lake | 4/541.4 |
| 5,418,984 | A | * | 5/1995 | Livingston, Jr. | 4/541.1 |
| 5,920,923 | A | * | 7/1999 | Jillette | 4/541.1 |
| 5,930,851 | A | * | 8/1999 | Brunelle | 4/541.1 |

* cited by examiner

*Primary Examiner*—Charles E. Phillips
(74) *Attorney, Agent, or Firm*—Howard & Howard

(57) ABSTRACT

An aerated bath 26 is disclosed comprising a plurality of receptacles 10 on the outside of the bath, each receptacle being in communication with the interior of the bath through one or a plurality of openings 16, and fluid supply means 20 connected to some or all of the receptacles characterised in that the receptacles are shallow and of a relatively smooth internal configuration. Preferably, the internal configuration of the receptacles is a part spherical dish. The smooth internal surface reduces locations where moisture can be trapped. Preferably also, the receptacle is made from a material, especially a plastics material, which is hydrophobic which therefore resists wetting by bath water. The plastics material is preferably easily machinable, and tough and durable, and may be selected from known plastics materials of this type such as nylon, polyethylene terephthalate, and the like. In a preferred form of the invention, the receptacles 10 are outwardly generally cylindrical in configuration, containing the dish portion in their upper face 14. The receptacles can conveniently be adhered to the outside of the bath (or the outside of the inner skin of the bath where the bath is double skinned) by means of known available water resisting adhesives. Preferably, an orifice 16 is provided radially of the cylindrical receptacle communicating with the dished portion to provide the fluid inlet. A suitable nonreturnable check 18 valve may be incorporated within the confines of the radial orifice to prevent water from entering the air distribution system. The valve mechanism may be one of various known types such as ball and seat mechanism, or of the diaphragm type, offering a very low resistance to opening in the direction of fluid flow and providing a good seal against any flow reversal.

15 Claims, 5 Drawing Sheets

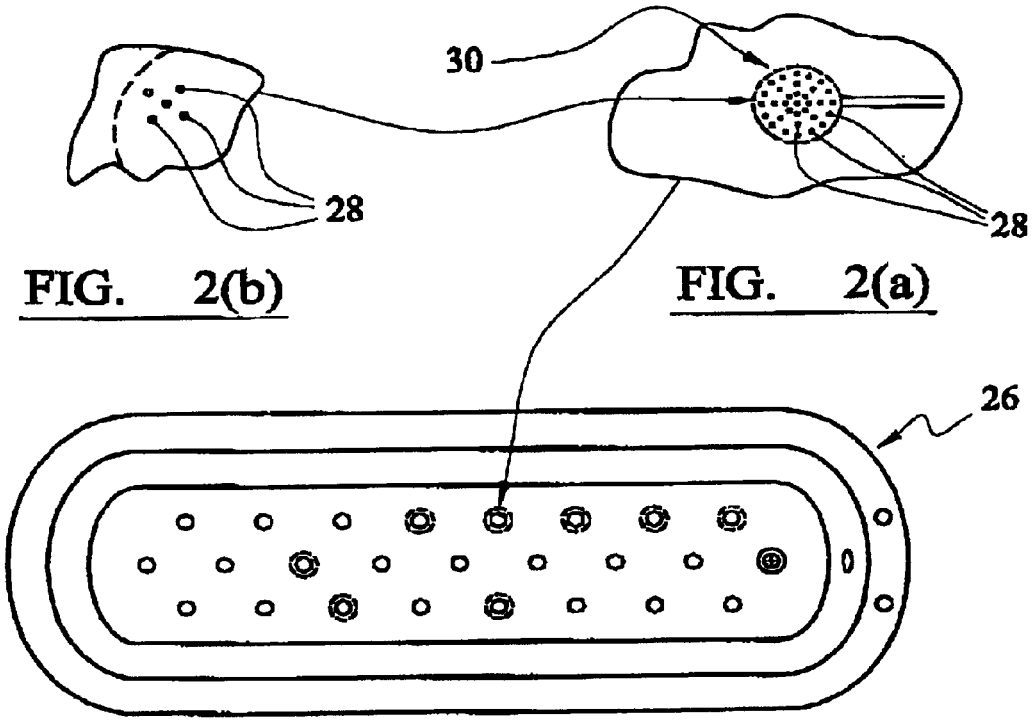
FIG. 2(b)
FIG. 2(a)
FIG. 2
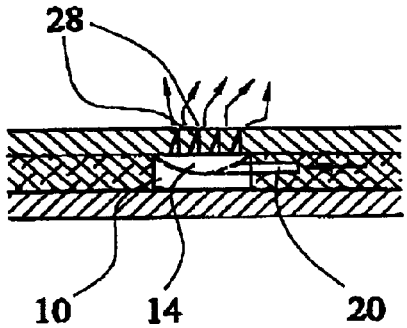
FIG. 2(c)
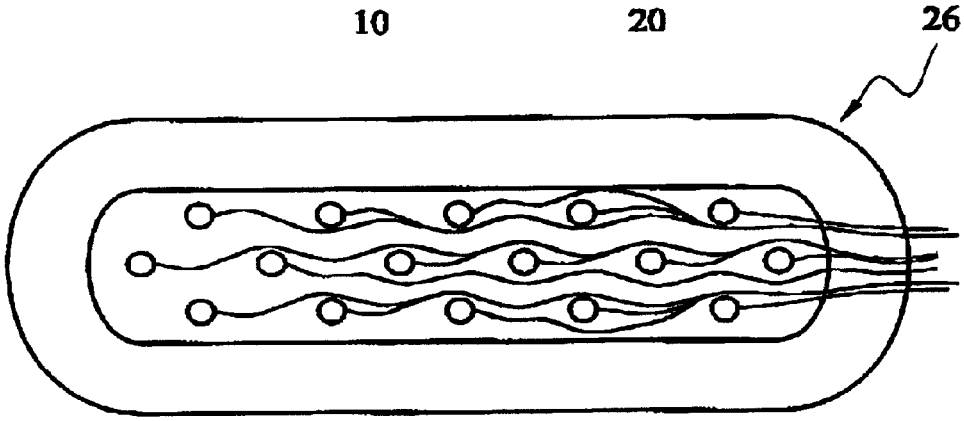
FIG. 3(b)

AERATED BATH

This invention related to aerated baths, and in particular to baths of the kind configured or adapted to introduce fluid under pressure into the bathing medium thereby agitating it and providing a massaging or toning effect to the user.

Baths of this general type are available, and one proposal provides at least one chamber on the outside of the bath and extending beneath the bath, the chamber communicating with openings through which aerating fluid, for example air, is forced into the bathing medium, e.g. water. While this system works well, when the bath is empty water can pass through the holes into the chamber where it is difficult to remove. Given the warm and damp environment of a bathroom, this can lead to rapid growth of harmful fungus and the possible risk of biological contamination of bath water in subsequent usage.

The present invention seeks to provide an aerated bath improved in the above respects.

According to the present invention, there is provided an aerated bath comprising a plurality of receptacles on the outside of the bath, each receptacle being in communication with the interior of the bath through one or a plurality of openings, and fluid supply means connected to some or all of the receptacles characterised in that the receptacles are shallow and of a relatively smooth internal configuration.

Preferably, the internal configuration of the receptacles is a part spherical dish. The smooth internal surface reduces locations where moisture can be trapped. Preferably also, the receptacle is made from a material, especially a plastics material, which is hydrophobic which therefore resists wetting by bath water. The plastics material is preferably easily machinable, and tough and durable, and may be selected from known plastics materials of this type such as nylon, polyethylene terephthalate, and the like.

In a preferred form of the invention, the receptacles are outwardly generally cylindrical in configuration, containing the dish portion in their upper face. The receptacles can conveniently be adhered to the outside of the bath (or the outside of the inner skin of the bath where the bath is double skinned) by means of known available water resisting adhesives.

Preferably, an orifice is provided radially of the cylindrical receptacle communicating with the dished portion to provide the fluid inlet. A suitable non-returnable check valve may be incorporated within the confines of the radial orifice to prevent water from entering the air distribution system. The valve mechanism may be one of various known types such as ball and seat mechanism, or of the diaphragm type, offering a very low resistance to opening in the direction of fluid flow and providing a good seal against any flow reversal.

In accordance with a preferred aspect of the invention, the receptacle additionally incorporates a heating element such as an electrical heating element, for example of the positive temperature co-efficient type, to assist in the thorough drying of the receptacles. The heating element may be regulated manually or maybe controlled automatically so as to come on when the relative humidity conditions exceed a specific level, for example 80% relative to humidity which is a level known to promote bacterial or mould growth.

Each receptacle may be located below a single hole but it is greatly preferred in that accordance with the invention that each receptacle is located below a cluster of holes. The holes may typically be in the order of 1 mm in diameter. Several clusters may be arranged in a symmetrical pattern. The size of the holes is chosen in relation to the volume and pressure of air available from an air blowing unit.

The invention will be described further, by way of example, with reference to the accompanying drawings in which:

FIGS. 1*a*, 1*b* and 1*c* are respectively a side elevational view, a top plan view, and a section on line x–x', of a receptacle for use in accordance with the invention;

FIG. 2 is a top plan view of a bath, in which 2*a* and 2*b* are enlarged details and FIG. 2*c* is a partial cross-section;

FIG. 3*a* is a sectional view through a bath in accordance with the invention;

FIG. 3*b* is a bottom plan view of the bath of FIG. 3*a;*

Figure 1A:
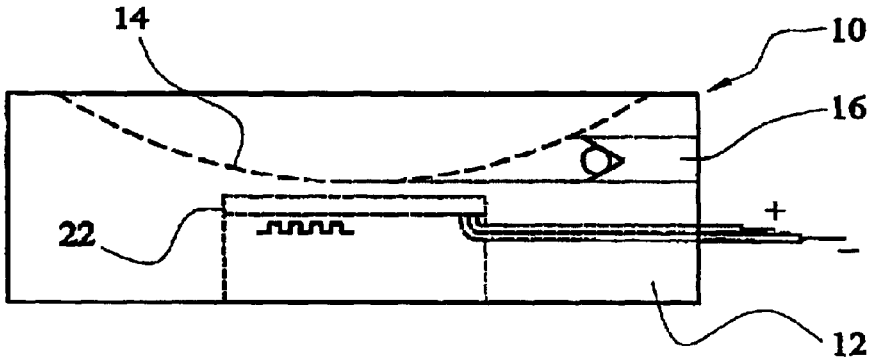
Figure 1B:
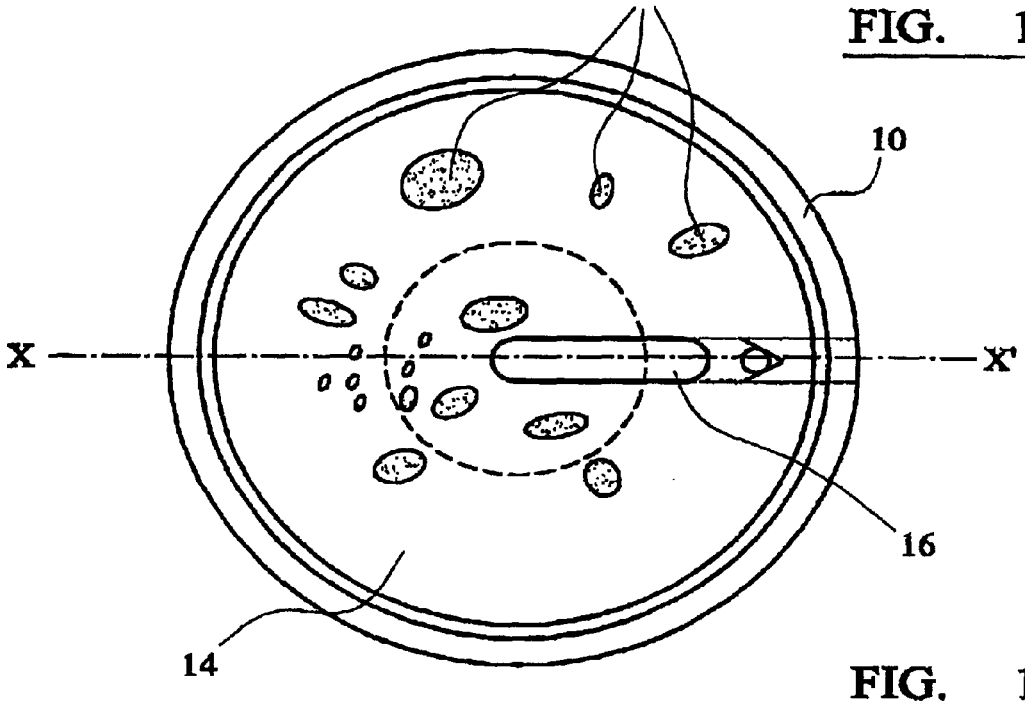
Figure 1C:
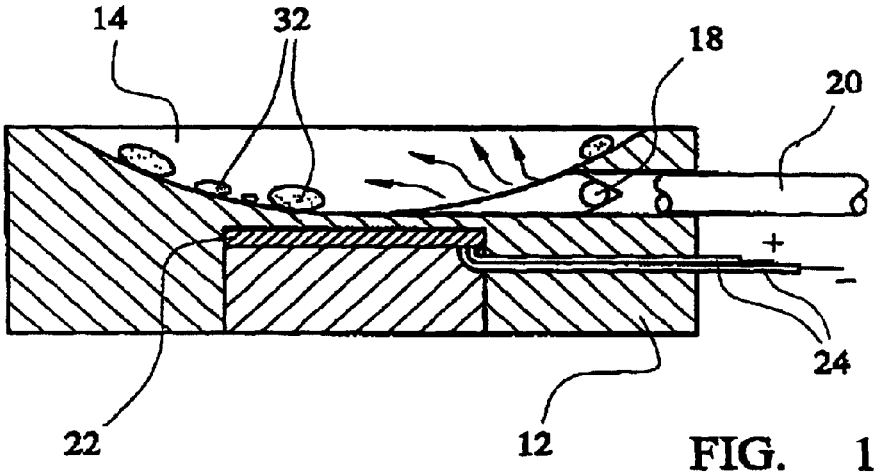

Referring to the drawings, FIG. 1 illustrates a receptacle for use in the aerated bath of the invention. The receptacle, generally designated 10, comprises a generally cylindrical body 12 having a part-spherically dished top portion 14. A radially inwardly extending orifice 16 connects with the dished chamber 14. An non-return valve 18 is located in the orifice 16, which is in turn connected to an air line 20.

A heating element 22 is embedded within the receptacle 10 and connected by wires 24 to a suitable electrical supply. The heating element 22 is located immediately beneath the dished portion 14.

Figure 3A:
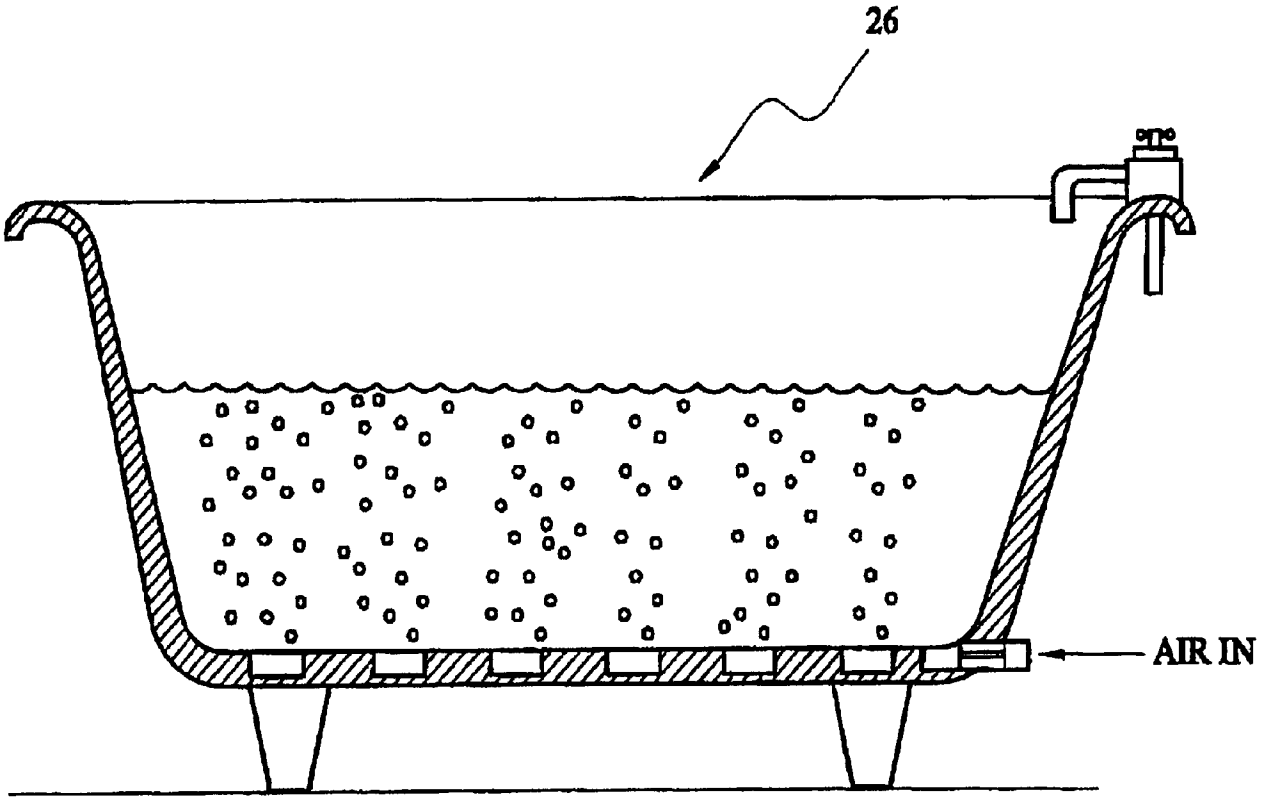

FIGS. 2 and 3 illustrate the bath generally designated 26. Clusters of holes 28 in symmetrical or other patterns are drilled within an area capable of being covered by the dished portion 14 of the receptacle 10. The size and spacing of the holes will vary according to available air pressure, type of aeration desired, and aesthetic factors. Each cluster 30 of holes 28 is, on the underside of the bath, covered by a respective receptacle 10 each having a respective air line 20 attached thereto. The air lines 20 are taken to a suitable manifold (not shown) and thence to an air supply (see FIG. 4).

In use, air is blown through the lines 20 into the dished portions 14 of the receptacles 10 and thence via the holes 28 into the bath 26 aerating the bathing medium, for example water. When the bath is emptied drops of water 32 (see FIG. 1*b*) may remain on the surface of the dished portion 14. The nature of the material forming the receptacles 10 is hydrophobic and so the water remains as discrete droplets or beads rather than wetting the surface. This water may be removed by blasting further air into the dished portion 14 and/or applying electrical current to the heating elements 22 whereby to evaporate any residual water.

Figure 4:
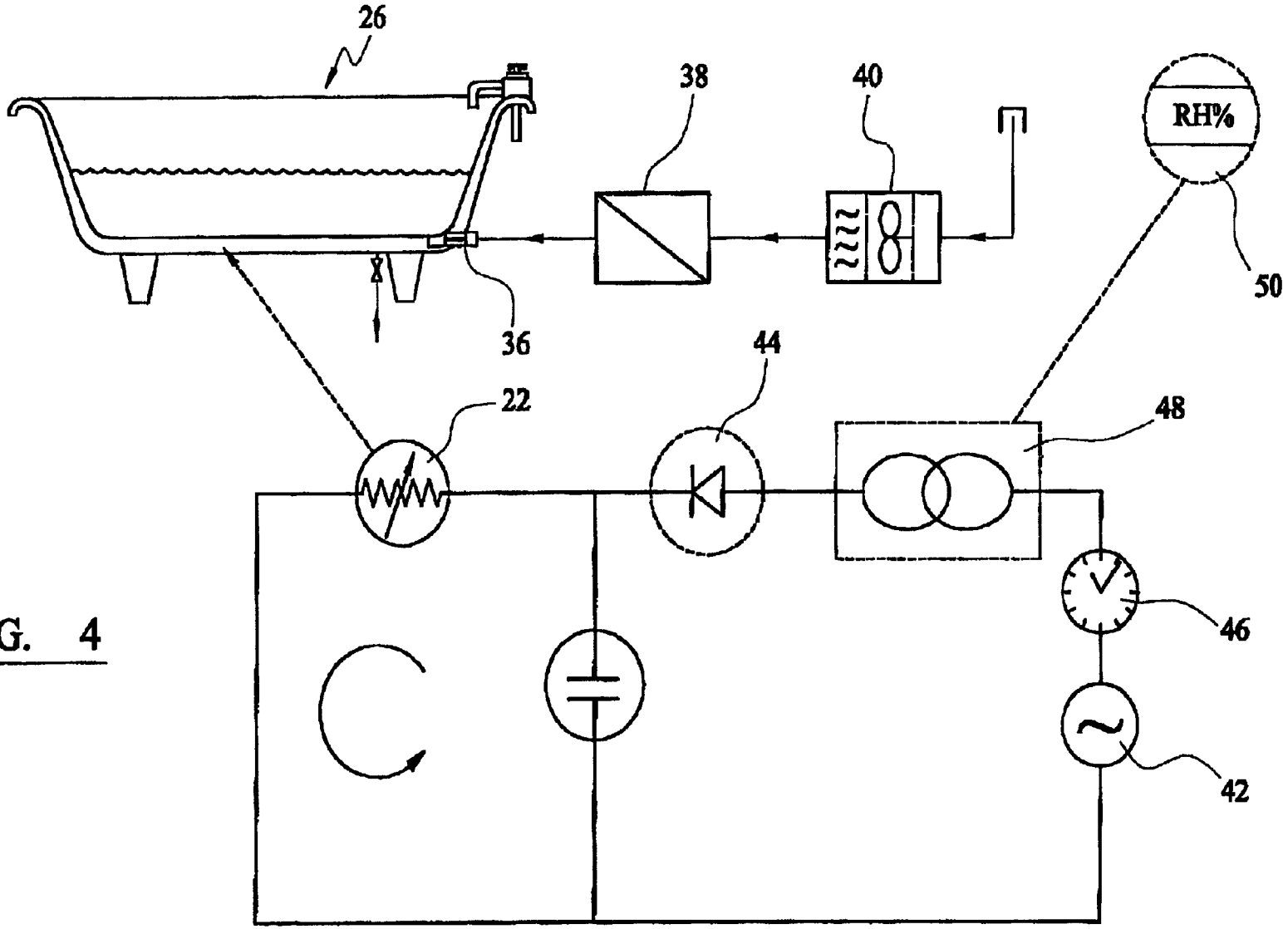
FIG. 4 is a schematic diagrammatic view of a control system for the bath.

Turning now to FIG. 4, it can be seen that the air lines 20 are connected via a manifold 36 and an air flow regulator 38 to an air blower 40. The blower 40 may be supplied with a heater so as to supply warm air if desired for actual use in aeration of the bath and/or for use in drying the receptacles 10 once the bath has been emptied. The heating elements 22, shown in schematic in FIG. 4, can be controlled as indicated therein wherein an a.c. supply 42 passes through a rectifier 44 to produce low voltage d.c. A timer 46 can be incorporated into the circuit, as can a relay 49 activated by a bathroom humidity sensor 50. With this set up, the heating element 22 is automatically supplied with power whenever the relative humidity rises above a preset level.

Figure 5:
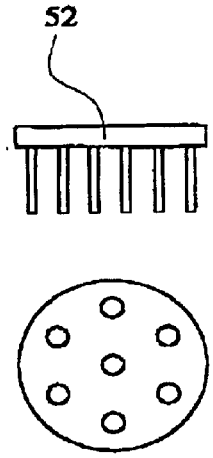
FIG. 5 is a diagrammatic view of a plug seal for use with the bath of the invention.
Figure 6:
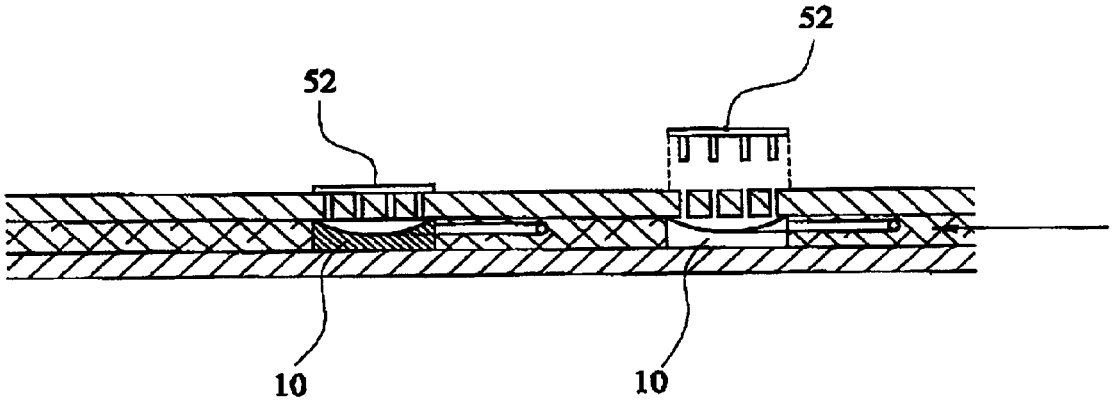
FIG. 6 is a cross-sectional view showing the plug seal in use.
Figure 7:
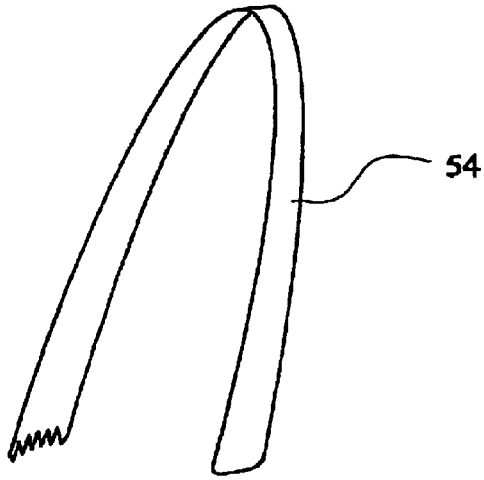
FIG. 7 is a diagrammatic elevational view of a plug seal removal tool.

Turning now to FIGS. 5 to 7, it is convenient to provide plug seals 52 which are essentially made of a flexible plastics material disc having projections or spines corresponding to the pattern of holes 28 within a cluster 30. This enables the holes to be blanked off to prevent ingress of dirt, moisture, and the like while the bath is stored or shipped. Indeed, the plug seals may be left in place until the bath has been set up with an air supply so that the bath can be used as a conventional bath until that time. This enables baths to be pre-drilled and supplied whether for aerated use or non-aerated use. To remove the plug seals 52 a tool 54 having a curved or saw edge is useful.

Where baths are of a single skin constructions the receptacles 10, air line 20 and the like are located on the outside of the bath. Where, however, baths are of double skin construction then the receptacles and air lines, etc, are preferably located between the two skins and "outside" is to be construed accordingly.

It is possible, and in some cases desirable, to regulate the air supply to different receptacles, located in different areas of the bath, to give greater or lesser degrees of aeration rather than a uniform air supply to all receptacles. This can be achieved by varying the diameter of the tubes 20, providing valves, or in any other suitable way.

The bath of the invention is simple and economical to make, effective in use, and reduces or eliminates the problem of mould or fungus build-up through water remaining in the aeration system.

What is claimed is:

1. An aerated bath comprising a plurality of receptacles on the outside of the bath, each receptacle being in communication with the interior of the bath through one or a plurality of openings, and an air supply connected to some or all of the receptacles and characterised in that the receptacles are shallow and present a continuously curving and concave surface internally from the periphery thereof, said air supply directed to direct air along said surface to remove liquid from said surface.

2. A bath as claimed in claim 1 wherein the receptacles are outwardly generally cylindrical in configuration, containing the dish portion in their upper face.

3. A bath as claimed in claim 2 wherein the receptacles are adhered to the outside of the bath by means of known available water resisting adhesives.

4. A bath as claimed in claim 2 wherein an orifice is provided radially of the cylindrical receptacle communicating with the dished portion to provide the fluid inlet.

5. A bath as claimed in any of claim 1 wherein each receptacle is located below a cluster of holes.

6. A bath as claimed in claim 5 wherein the holes are in the order of 1 mm in diameter.

7. An aerated bath comprising a plurality of receptacles on the outside of the bath, each receptacle being in communication with the interior of the bath through one or a plurality of openings, and an air supply connected to some or all of the receptacles and characterised in that the receptacles are shallow and present a continuously smooth surface internally from the periphery thereof wherein the internal surface of the receptacles is a part spherical dish, said air supply directed to direct air along said surface to remove liquid from said surface.

8. An aerated bath comprising a plurality of receptacles on the outside of the bath, each receptacle being in communication with the interior of the bath through one or a plurality of openings, and fluid supply means connected to some or all of the receptacles and characterised in that the receptacles are shallow and of a continuously smooth configuration internally from the periphery thereof wherein each receptacle additionally incorporates a heating element to assist in the thorough drying of the receptacles.

9. A bath as claimed in claim 8 wherein the heating element is regulated by one of manually and automatically in response to the relative humidity conditions exceeding a specific level which is a level known to promote bacterial or mould growth.

10. A aerated bath comprising a plurality of receptacles on the outside of the bath, each receptacle being in communication with the interior of the bath through one or a plurality of openings, and fluid supply means connected to some or all of the receptacles and characterized in that the receptacles are shallow and of a continuously smooth configuration internally from the periphery thereof, wherein said fluid supply means includes an orifice extending radially of said receptacle to provide a fluid inlet, and a non-returnable check valve incorporated within the confines of said orifice to prevent water from entering the air distribution system.

11. A bath as claimed in claim 10 wherein the valve mechanism is a ball and seat mechanism, or of the diaphragm type, offering a very low resistance to opening in the direction of fluid flow and providing a good seal against any flow reversal.

12. An aerated bath comprising a plurality of receptacles on the outside of the bath, each receptacle being in communication with the interior of the bath through one or a plurality of openings, and an air supply connected to some or all of the receptacles and characterised in that the receptacles are shallow and present a surface smooth configuration internally from the periphery thereof wherein each receptacle is made from a material which is hydrophobic which therefore resists wetting by bath water, said air supply directed to direct air along said surface to remove liquid from said surface.

13. A bath as claimed in claim 12 wherein the material is a plastics material.

14. A bath as claimed in either claim 12 wherein the material is easily machinable, and tough and durable.

15. A bath as claimed in claim 14 wherein the material is polyethylene terephthalate.

* * * * *